United States Patent [19]

Spikes et al.

[11] 4,180,895

[45] Jan. 1, 1980

[54] METHODS OF FORMING ANGLED END BEARING LINERS

[75] Inventors: Roger H. Spikes, Marlow; William J. G. Blackburn, Stanmore, both of England

[73] Assignee: Vandervell Products Limited, Maidenhead, England

[21] Appl. No.: 900,374

[22] Filed: Apr. 26, 1978

[30] Foreign Application Priority Data

Apr. 26, 1977 [GB] United Kingdom ..... 17448/77

[51] Int. Cl.[2] ..... B21D 53/10

[52] U.S. Cl. ..... 29/149.5 C; 29/413; 72/324

[58] Field of Search ..... 29/149.5 C, 149.5 R, 29/DIG. 33, 148.4 C, 412–415, 418; 113/120 F, 1 N, 116 Q, 116 A, 116 BB; 72/329, 33 G, 324

[56] References Cited

U.S. PATENT DOCUMENTS

| | | | |
|---|---|---|---|
| 1,787,255 | 12/1930 | Klocke | 29/149.5 C |
| 1,924,230 | 8/1933 | Davis | 29/149.5 C |
| 2,283,918 | 5/1942 | Decome | 29/149.5 R |
| 2,421,323 | 5/1947 | Fruengel | 29/413 X |
| 3,262,299 | 7/1966 | Hart et al. | 29/149.5 C X |
| 3,455,004 | 7/1969 | Tethal | 29/149.5 C |
| 3,825,991 | 7/1974 | Cornell | 29/412 |

FOREIGN PATENT DOCUMENTS

| | | | |
|---|---|---|---|
| 814287 | 9/1951 | Fed. Rep. of Germany | 29/413 |
| 1930914 | 12/1970 | Fed. Rep. of Germany | 29/412 |

*Primary Examiner*—Milton S. Mehr

*Attorney, Agent, or Firm*—Sughrue, Rothwell, Mion, Zinn & Macpeak

[57] ABSTRACT

Bearing bushes are made in groups or pairs by progressive press tooling so that at each stroke of the press a group or pair of bushes is produced. The bushes may have at least one end which lies in a plane inclined to the longitudinal axis of the bush, and this is effected by providing the bush blank in the flat with a sinusoidal boundary line.

10 Claims, 9 Drawing Figures

Station 1
Station 2
Station 3
Station 4
Station 5
Station 6
Station 7

METHODS OF FORMING ANGLED END BEARING LINERS

BACKGROUND OF THE INVENTION

1. Field of the Invention

This invention relates to methods of forming bearing bushes from strip material.

2. Description of the Prior Art

Conventionally, bushes are made by progressive press tooling from strip material and are formed one at a time. The conventional methods of forming bushes are well exemplified by U.S. Pat. No. 1,787,255 issued Dec. 30, 1930 and U.S. Pat. No. 1,964,584 issued June 26, 1934 both in the name of William H. Klocke. Bushes having clinch butts are disclosed e.g. in U.S. Pat. No. 2,283,918 issued May 26, 1942 in the name of A. Decome.

In these conventional methods, each stroke of the press would complete one bush. It is an object of the present invention to provide a method whereby two or more bushes can be completed for each stroke of the press.

The invention has particular application to the manufacture of bushes in which at least one end is inclined to the longitudinal axis of the bush. Such inclined end may lie in a plane inclined to said longitudinal axis.

Such bushes find application for receiving the gudgeon or wrist pin in a reciprocating piston and connecting rod assembly. The axially longer part of the bush is located near the position of maximum stress in use and by using bushes with angled ends one can arrange a greater effective bearing surface in a shorter axial length than with bushes having ends perpendicular to the longitudinal axis of the bush. These inclined end bushes may have only one end surface inclined to the longitudinal axis of the bush or may have both ends so inclined.

The conventional method of making an inclined end bush is to make the bush having ends which are perpendicular to the longitudinal axis of the bush and then to machine one or both of these ends to the required inclination. This is wasteful of material and requires special and expensive machinery.

SUMMARY OF THE INVENTION

According to the invention we provide a method of making bushes comprising:

(1) scoring or indenting strip material to provide a succession of bush blanks so that adjacent edges of adjacent blanks lie along a common score line or indent and so that groups of the blanks are provided on portions of the strip, each portion having a uniform length;

(2) successively forming the groups of the blanks to a circular cross-section tubular element consisting of a plurality of bushes interconnected along the score lines or indents between them, all the blanks of each group being so formed simultaneously and the longitudinal axis of the element being parallel to the direction in which said uniform length is measured;

(3) successively separating the tubular elements, or the groups of blanks before forming into such elements, from the remainder of the strip material; and (4) separating the bushes of each group from each other along said common score lines or indents.

Since the bushes are made in groups, one can either obtain a greater output of bushes for a given speed of running of the press or one can slow down the press to provide the same number of bushes and thus increase the period between necessary press maintenance.

Where the bushes are to have angled ends, the common score line or indent between at least some of the blanks of each group is of wave form and has a length of one wave length. Such wave form is preferably sinusoidal or approximately so. With such a wave form the end of the bush provided by the sinusoidal score line or indent will lie in a plane inclined to the longitudinal axis of the bush.

By "wave form" we mean a line which oscillates about an axis in a repeating manner and a wave length will be the length of one complete oscillation.

By making the portion of each strip material providing a group of blanks to be of uniform length, there are no difficulties in forming the material to circular cross section without distortion. This is particularly important when making bushes with angled ends because if one tried to make individual bushes with angled ends the width of each blank would vary along the length thereof and there would be distortion during circling. Moreover, if it is required to finish the outer surface of the bush, e.g. by grinding, distortion would occur in trying to grind an angled bush for the same reason that the width of the bush would vary along the circumferential length thereof. If it is desired to finish, e.g. grind, bushes made according to the invention then this will be effected before the bushes are separated from other bushes in the group.

The invention also includes bushes, particularly bearing bushes, when made by the methods of the invention.

BRIEF DESCRIPTION OF THE DRAWINGS

The invention will now be described in detail by way of example with reference to the accompanying diagrammatic drawings in which.

DESCRIPTION OF THE PREFERRED EMBODIMENTS

Figures 1, 2, 3, 4, 5:
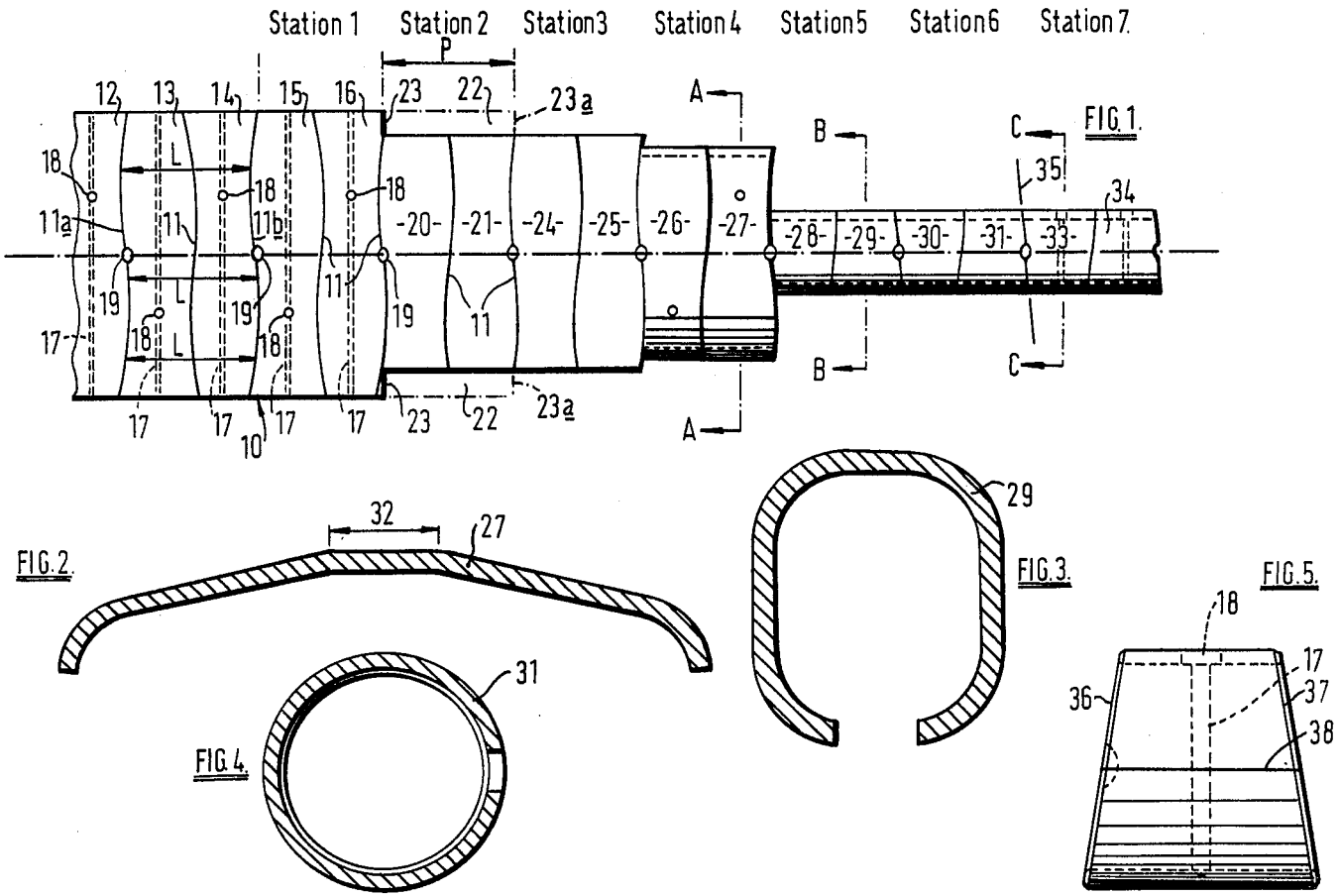
FIG. 1 shows the progressive formation of pairs of bushes in one method embodying the invention.
FIGS. 2, 3 and 4 are cross sections through the strip of material on the lines A—A, B—B and C—C respectively of FIG. 1.
FIG. 5 is an elevation of a finished bush.
Figure 6:
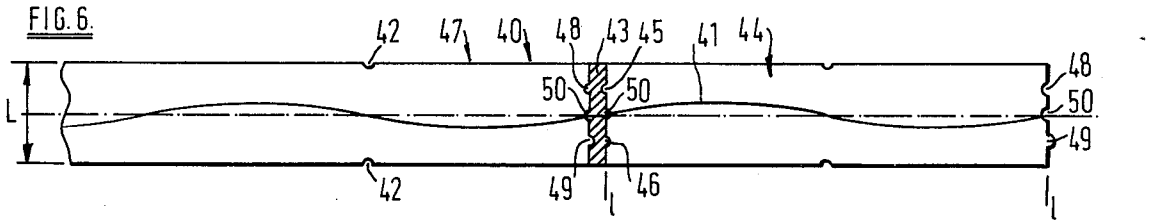
FIG. 6 shows the scoring or indenting of strip material to form pairs of bushes in a second method embodying the invention.

Referring now to FIG. 1, a strip of bearing material is indicated generally at 10. This strip will be a strip of steel having, on one face thereof, bearing material which may have been deposited by casting or by rolling the steel and the strip of bearing material together. An example of such a bearing material would be a steel backing layer of the thickness of 0.0100" and on one face thereof a layer of bearing material, such as leaded bronze or aluminum tin alloy, of a thickness of 0.030."

At the left hand end of FIG. 1, the strip has been scored or indented with a plurality of score lines or indents which are approximately of sinusoidal form. These indents or scores are made on both sides of the strip material and are indicated at 11. The width of the strip is greater than one wave length of the sinusoidal wave form. It will be noted that adjacent score lines or indents 11 are 180° out of phase. The score lines or indents divide the strip into a number of bush blanks some of which are indicated at 12 to 16. Grooves are embossed in the lower surface of the strip material as indicated at 17 for the blanks 12 to 16 and each blank has drilled or pierced therein an oil-hole 18 which intersects the oil groove 17.

The method to be described forms the bushes in pairs, i.e. groups of two. The length, measured along the length of the strip, of each pair of blanks is uniform. Thus if one takes, for example, the pair of blanks 13 and 14, the distance measured parallel to the lengths of the strip between the two boundary score lines or indents of the pair, referred to as 11*a* and 11*b* is uniform. Thus, for example, a length L is indicated at various positions and since the wave forms of the lines 11*a* and 11*b* are in phase the length L will be the same at any point across the width of the strip between the two lines 11*a* and 11*b*. It is to be noted that the strip is formed with tooling holes 19 on each alternate score line or indent 11. The provision of these tooling holes does, over a very short length, mean that the length of the blank pair will be less than L but this departure from a uniform length is *de minimis* and is ignored.

The purpose of having the length L uniform is that each pair of blanks when being formed to circular section has, within normal tolerances, a uniform length and therefore uniform resistance to formation and therefore will not distort. The presence of the tooling holes 19 will not affect the resistance and can therefore be ignored.

The strip progresses through the tooling in steps having a length P as shown i.e. substantially the length L. In the first stage of the progression therefore, at station 1 and as shown for the blanks 12 to 16, the score lines or indents 11 are provided, the oil grooves 17, the oil holes 18 and the tooling holes 19. At station 2 the blanks have their ends sheared so that the length of each score line or indent between adjacent blanks is equal to one wave length. Thus blanks 20 and 21 are at station 2 and it will be seen that their ends have been sheared so that the score lines 11 between them have a length of one wave length. After shearing away the portions of strip indicated at 22 the shoulders 23 on the strip engage stops at the positions indicated at 23*a* and thereby serve to control the progress of the strip to the right in FIG. 1.

After station 2 each pair of blanks moves to station 3 where no further action is taken on the blanks, the blanks at station 3 being indicated at 24 and 25.

The blanks then move to station 4 and the two blanks at station 4 are indicated at 26 and 27. At this station, the blanks of the pair are simultaneously deformed to the first form cross section shown in FIG. 2. The pair of first form blanks then moves to station 5 and the blanks at this station are indicated at 28 and 29 and are formed to the second form cross section shown in FIG. 3. The pair of second form blanks then moves to station 6 where no further forming takes place and then moves to station 7 where final forming or knuckling takes place to bring the blanks to circular cross section about a mandrel as shown in FIG. 4, and at the same time the bushes are cropped off along the line 35 from the blank pair 30/31.

The tooling for effecting this progressive formation is substantially conventional, except that it is adapted for making more than one blank at a time, and is described in the U.S. patents referred to above. It will be appreciated that at station 4, the pair of first form blanks 26, 27 is partially sheared from the pair of blanks 24, 25 but remains attached to the pair of blanks 24 and 25 over the length indicated at 32 in FIG. 2. All the blanks therefore remain interconnected up to and including station 6.

The bush pair 33, 34 is then subjected to whatever finishing operation, if any, is required such as grinding the outside of the bush pair. Since the bush pair will comprise a tubular element of uniform length, grinding may be carried out without deformation.

Finally, the bushes of the pair 33, 34 are separated from one another. The separation will be in a direction perpendicular to the plane of the drawing so as to avoid one bush interfering with the other.

The final form of the bush is shown in FIG. 5. It will be seen that the bush has ends 36 and 37 which are angled with respect to the longitudinal axis of the bush. It will be seen that the oil groove 17 extends circumferentially within the bush substantially centrally thereof and communicates with the oil hole 18. The axial joint 38 in the bush is located mid-way, in a circumferential sense, between the part of the bush having the minimum axial length and the part of the bush having the maximum axial length.

In the method so far as described, the bush blanks have had their lengths extending transversely of the length of the strip. In the method now to be described with reference to FIGS. 6 to 9 the bushes are made in pairs with the score lines or indents between the bush blanks extending lengthwise of the strip.

Referring now to FIGS. 6 to 9 a strip of bearing material is indicated at 40. This strip is indented or scored with a line 41 which is approximately sinusoidal. It will be seen that the edges of the strip are parallel but have been pierced at intervals at 42 to provide cut-outs for tooling. The width of the strip is uniform and therefore the length L of each strip portion providing a pair of blanks is uniform, the cut-outs 42 being ignored as de minimis. The strip is fed to the right to progress the tooling and is separated into lengths by a cropping tool having the shape indicated at 43. This cropping tool produces, at the left-hand end of a pair 44 of blanks, a projection 45 and recess 46 and at the right hand end of the pair of blanks 47 a recess 48 and a projection 49. In a previous operation of the tool a recess such as 48 and a projection 49 would have been formed at the right-hand end of the blank pair 44. In an alternative arrangement the tool could provide two recesses at one end of the blank pair and two projections at the other end of the blank pair. A fitting notch 50 is also provided in the end of the pair of blanks. The cropping tool crops the strip into blank pairs such that the length of each indent or score line 41 for the blank pair between the lines is equal to one wave length.

Figure 9:
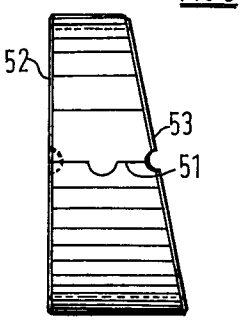
FIG. 9 is a side elevation of a finished bush made by the second method.
Figure 8:
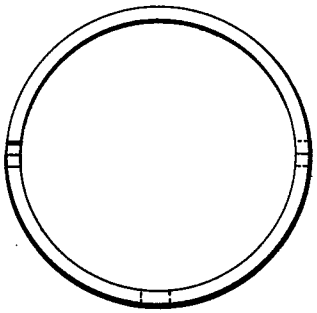
FIG. 8 is a cross sectional view of the pair of bushes of FIG. 7.
Figure 7:
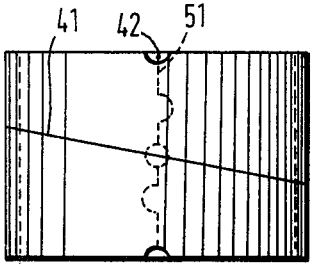
FIG. 7 is a plan view of a pair of bushes made from the strip of FIG. 6.

Each blank pair is then formed into circular cross-section as shown in FIGS. 7 and 8. In circling the blank pair the projection 45 fits into the recess 48 and the projection 49 fits into the recess 46 so that one obtains a clinch butt as indicated at 51 in FIG. 7. As shown in FIGS. 7 and 9 there is a bush pair each bush of which, as shown in FIG. 9, has one end 52 which is perpendicular to the longitudinal axis of the bush and one end 53 which is inclined to the longitudinal axis. The clinch butt 51 is located mid-way, in a circumferential sense, between the part of the bush having the axially shortest length and the part of the bush having the axially longest length.

It will be seen that in this method each pair of bush blanks is sheared from the strip before being formed into circular shape. A pair of bush blanks such as shown in FIGS. 7 and 8 will, if necessary, be finished, e.g. by grinding of the outer surface, and will then be separated one from another along the score line or indent 41. The separation will take place perpendicular to the plane of the paper so as to avoid one bush interfering with the other during separation.

The invention has been described in detail with reference to the making of bushes with angled ends and the making of bushes in pairs. The invention is more widely applicable, thus it could be used for making bushes in groups other than pairs. Thus, for example, in the first method of FIGS. 1 to 5 four bush blanks could be formed simultaneously to circular form and then separated into their independent bushes.

In the method of FIGS. 6 to 9, the strip could be wider than shown to enable, say, a portion of strip containing four bush blanks to be made and formed to circular section.

Moreover, the method of FIGS. 1 to 5 could be used for making bushes of the shape shown in FIG. 9. This would be effected by changing each alternate score line or indent 11 to a straight line. If desired, each method could also be used for making bushes in pairs or groups where the bushes have edges which are perpendicular to the longitudinal axis of the bush, and this would be effected by replacing all the sinusoidal lines with straight lines. Bushes as made by the method of FIGS. 1 to 5 could also have clinch butts as described in relation to FIGS. 6 to 9.

Although it is preferred that the wave form shall be sinusoidal, or approximately so, other wave forms may be used e.g. if it is desired to provide non-planar formations on the ends of the bushes. As used in the accompanying claims it is to be understood that the term "scoring" is to be broadly interpreted to include, inter alia, indenting.

We claim:

1. A method of making bushes having the plane of at least one axial end thereof inclined to the longitudinal axis of the bush, comprising:

(a) scoring strip material to provide a succession of groups of bush blanks so that adjacent edges of adjacent blanks in each group lie along common score lines, such common score lines having an undulating wave form and a length of one wave length, and so that each group of blanks is provided on a portion of the strip material of uniform length;

(b) successively forming the groups of the blanks to a circular cross-section tubular element consisting of a plurality of bushes interconnected along said common score lines between them, all the blanks of each group being so formed simultaneously and the longitudinal axis of the element being parallel to the direction of said uniform length;

(c) successively separating the tubular elements, or the groups of blanks before forming into such elements, from the remainder of the strip material; and (d) separating the bushes of each group from each other along said common score lines.

2. A method as claimed in claim 1, wherein each group of bush blanks comprises a pair thereof of one wave length.

3. A method according to claim 1 wherein said wave form is substantially sinusoidal.

4. A method according to claim 3 wherein the scoring is so located that the axial split line in each finished bush lies midway, in circumferential sense, between the maximum and minimum lengths of the bush.

5. A method according to claim 1, wherein said scoring provides blanks whose lengths lie along the strip, wherein the width thereof equal to said uniform length, and wherein the groups of blanks are sheard from the remainder of the strip before forming the groups to circular cross section.

6. A method according to claim 5 wherein the edges of the strip are parallel and the score line between adjacent blanks of each group runs lengthwise of the strip.

7. A method according to claim 1, wherein the strip material is scored so that the lengths of the blanks lie transversely of the strip and so that adjacent groups of blanks have edges meeting along a common line.

8. A method according to claim 1 wherein the scoring is carried out so that the common score line between each pair of blanks is a sinusoidal line of the same wave length as the common score line between the blanks of each pair, said common lines being 180° out of phase.

9. A method according to claim 1 including grooving and piercing the blanks before forming them to circular cross section to provide oil grooves and holes in the finished bushes.

10. A method according to claim 1 including forming the blanks so that the finished bushes have clinch butts.

* * * * *